US005150824A

United States Patent [19]

Alvarez et al.

[11] Patent Number: 5,150,824

[45] Date of Patent: Sep. 29, 1992

[54] DUAL PURPOSE UNITIZED PACK

[75] Inventors: Vincent H. Alvarez; Nancy C. Dendramis, both of Cincinnati, Ohio

[73] Assignee: Sally M. Key, Cincinnati, Ohio

[21] Appl. No.: 739,086

[22] Filed: Aug. 1, 1991

[51] Int. Cl.[5] ..... A45C 15/00

[52] U.S. Cl. ..... 224/151; 224/226; 224/228; 224/202

[58] Field of Search ..... 224/151, 224, 226, 227, 224/228, 229, 202, 205; 383/2, 75, 100, 102, 117; 190/103, 104, 105

[56] References Cited

U.S. PATENT DOCUMENTS

| | | | |
|---|---|---|---|
| D. 238,725 | 2/1976 | Zerobnick | D2/381 |
| D. 261,196 | 10/1981 | Griffin | D2/383 |
| 2,351,158 | 1/1943 | Stelzer | 224/5 |
| 2,573,214 | 10/1951 | Moran | 383/102 X |
| 3,389,784 | 6/1968 | Hendricks | 206/47 |
| 3,777,498 | 12/1973 | Andrews et al. | 383/102 X |
| 4,424,841 | 1/1984 | Smith | 224/151 X |
| 4,523,703 | 6/1985 | McKenna | 224/224 |
| 4,545,414 | 10/1985 | Baum | 150/52 |
| 4,634,031 | 1/1987 | Frankhouse | 224/205 |
| 4,700,761 | 10/1987 | Gladding | 224/205 X |
| 4,940,173 | 7/1990 | Jacober | 224/151 |
| 4,993,614 | 2/1991 | Bonofiglo | 224/253 |

FOREIGN PATENT DOCUMENTS

| | | | |
|---|---|---|---|
| 521286 | 8/1955 | France | 383/2 |

*Primary Examiner*—Henry J. Recla
*Assistant Examiner*—Glenn T. Barrett
*Attorney, Agent, or Firm*—Charles R. Wilson

[57] ABSTRACT

A dual purpose unitized pack is capable of use as a container for conveniently holding a limited measure of articles as well as a container for holding a relatively substantial measure of articles. The unitized pack comprises a pouch, a substantially flat enclosure member attached to the pouch, an open top collapsible sack positioned in the enclosure member and attached thereto and a belt attached at least on one end to the pouch. The open top sack is capable of being fully contained within the enclosure member and the enclosure member folded behind the pouch during non-use. In use, the enclosure member is folded out and closures on an upper edge and a lower edge thereof opened to access the flexible sack. The sack drops through the lower edge opening to a fully extended state capable of holding the relatively substantial measure of articles.

19 Claims, 4 Drawing Sheets

DUAL PURPOSE UNITIZED PACK

This invention relates to a pack to be worn around the waist or over the shoulder of the user. More particularly, the invention relates to a dual purpose unitized pack capable of holding a limited measure of articles or a relatively substantial measure of articles.

Various personal use containers of all types and sizes have been devised over the years to serve as a means for holding and transporting articles. Purses, for example, are in wide spread use. They are available in a variety of shapes and sizes. Some are hand-held while others have straps for use as a handle or for use over the shoulder. Many other personal use containers are on the market, including several special use containers. For example, fishing tackle boxes, tennis racket holders, ball bags, duffel bags, hunter cartridge belts, umbrella cases, brief cases, money belts, and change containers are just a few of the many personal containers which were developed for one or perhaps a very limited use. Moreover, some of the specialized use containers were developed primarily for specific weather conditions, e.g. rain or snow. In all instances, the containers are intended to lessen the burden of containing one or more articles and of transporting the contained articles in a secure manner, given the intended use conditions likely to be encountered.

Outdoor recreational activities such as biking and hiking have recently become very popular. The activity can involve just the individual or perhaps a whole family group. Additionally, the activity can be extended so that the individual is away from home for hours at a time. Many outdoor activities also entail being in a wooded or secluded area away from many of the conveniences of home. At such times many outdoor enthusiasts desire access to water, food or other items perceived as necessities. Campers, of course, have long been accustomed to wearing a back pack containing several items needed to sustain the individual for a prolonged period of several hours or even several days. Many individuals are not that enthused. For them, a container which is capable of holding a drink, a meal, or perhaps rain gear is sufficient. That is, the small capacity of the container is adequate. Such a container which is worn in a manner to be virtually unnoticed is ideal.

There is currently being commercialized biker/hiker products referred to variously as "fanny packs" or "fanny huggers". These products have a small pouch with a strap. The product is worn around the waist with the pouch at the user's side, front or back as desired. The pouch portion of the product is usually made of a flexible, light weight and durable fabric. The nature of the product is such that it can be conveniently worn without interfering with the user's activity. When the contents of the pouch are used, the product is even less noticed by the user and less cumbersome. Of course, they are limited by their small size and consequent small capacity. Normally, this is no problem. The user simple adapts to the situation.

As the aforementioned biker/hiker products are becoming more popular, the product's limitations are becoming more apparent, and to some, more bothersome. There has now been developed a personal use container which has the advantages of the conventional biker/hiker products as well as added benefits. The containers are dual purpose in that they are capable of holding a limited measure of articles as well as capable of being converted to hold a relatively substantial measure of articles. The manner by which the container is converted does not interfere with the prime use for the container nor have any associated disadvantages.

SUMMARY OF THE INVENTION

A dual purpose unitized pack is capable of use as a container for conveniently holding a limited measure of articles as well as a container for holding a relatively substantial measure of articles. The unitized pack comprises a pouch for holding the limited measure of articles, a substantially flat enclosure member capable of folding into approximate halves with one-half attached to the pouch, an open top collapsible sack positioned at least partially in the enclosure member and permanently attached thereto along an upper edge, and a belt attached at least on one end to the pouch. The open top sack is capable of being fully contained within the enclosure member and the enclosure member folded behind the pouch during non-use. In use, the enclosure member is folded out and closure means on an upper edge and a lower edge opened to access the sack. The sack drops through the lower edge opening to a fully extended state capable of holding the relatively substantial measure of articles.

DETAILED DESCRIPTION OF THE INVENTION

The dual purpose unitized pack of this invention is described with particular reference to the drawings. The individual components of the pack as well as the manners of use of the pack are described in the following paragraphs.

Figure 1:
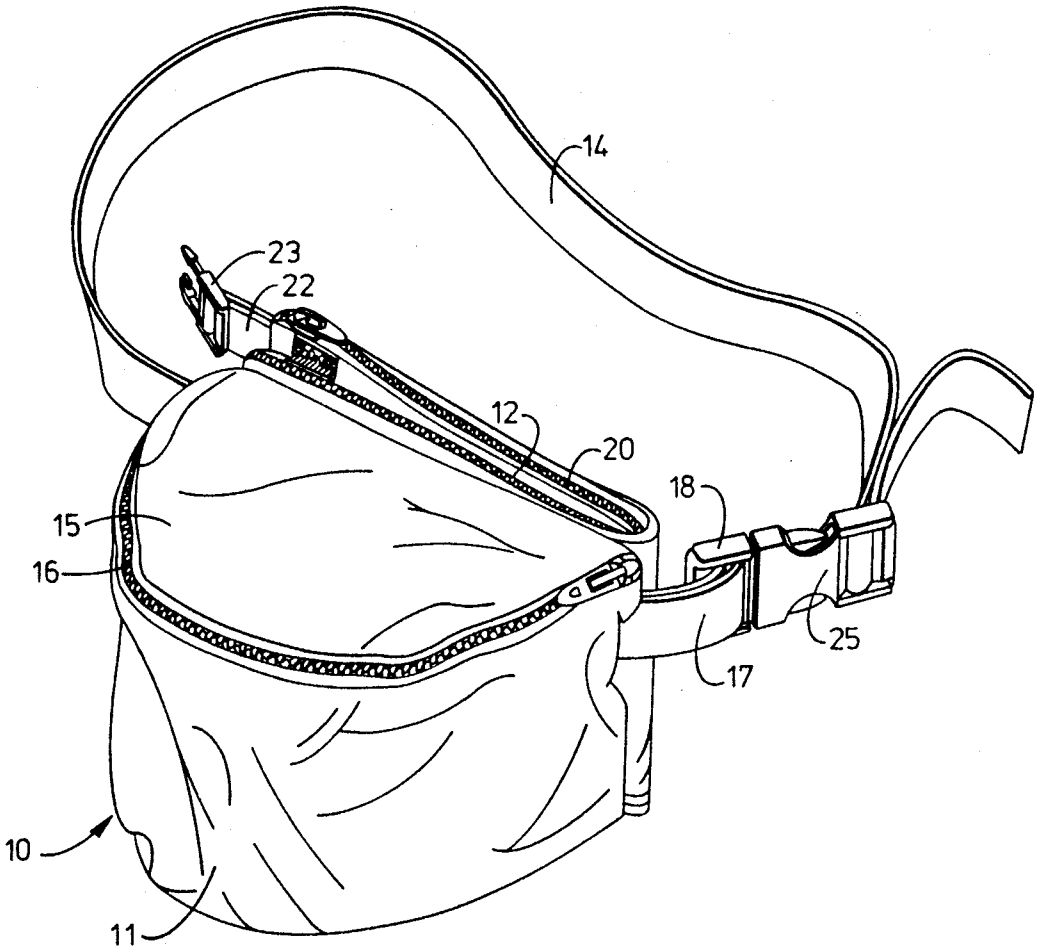
FIG. 1 is a perspective view of the dual purpose unitized pack of the invention in a closed state.
Figure 2:
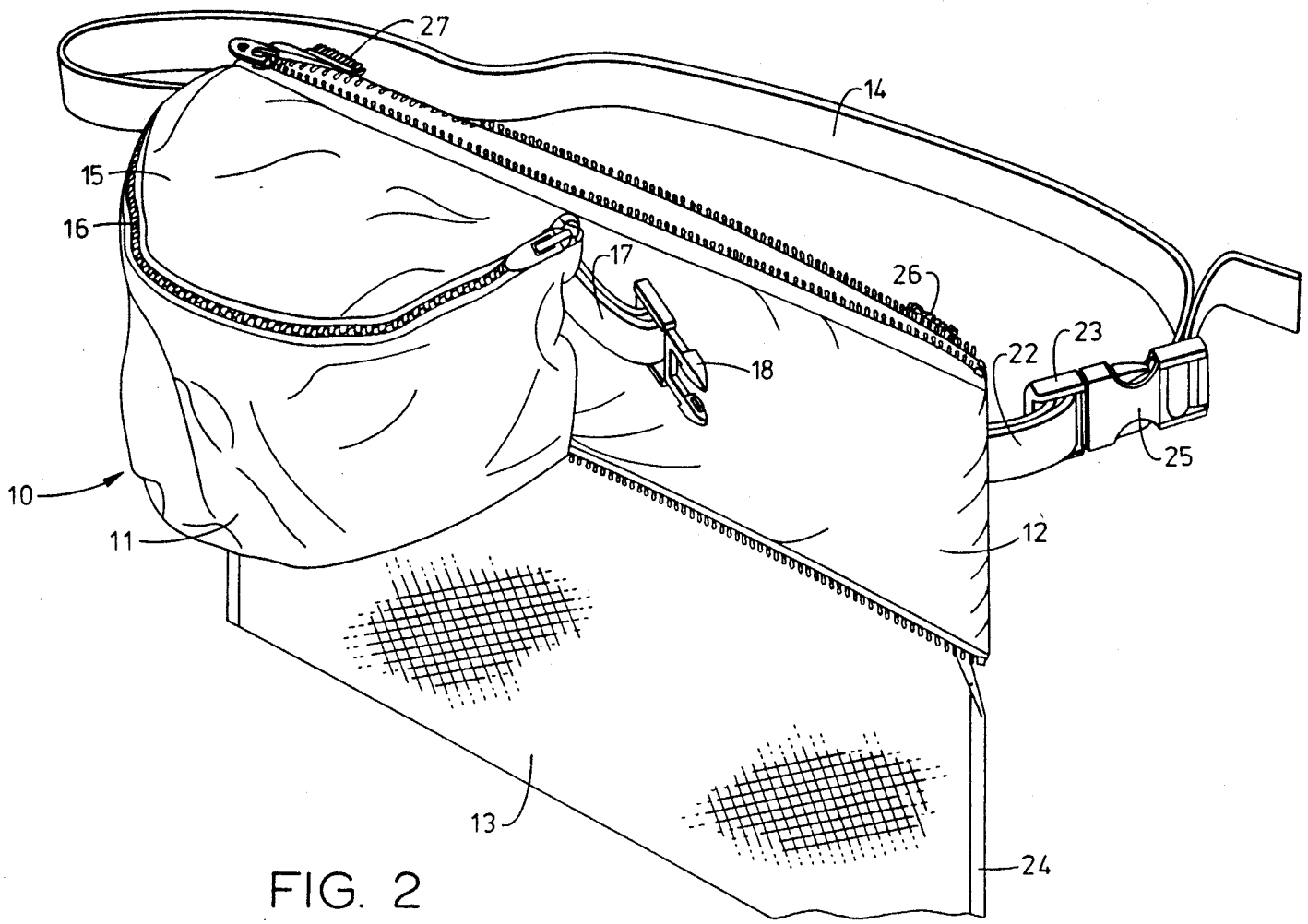
FIG. 2 is a perspective view of the dual purpose unitized pack of FIG. 1 in an open or fully extended state.

With reference to FIGS. 1 and 2 there is shown the dual purpose unitized pack 10 of the invention. The unitized pack comprises as its essential components a pouch 11, a substantially flat foldable enclosure member 12, a collapsible sack 13 and a belt 14. As shown in FIG. 1 the unitized pack is fully closed and ready for wearing on the waist or shoulder of its owner for the purpose of holding a limited measure of articles. As shown in FIG. 2, the unitized pack is fully opened with all its features fully extended ready for use as a container for a relatively substantial measure of articles.

The pouch 11 of the unitized pack 10 is a box-like structure which has a generally rectangular-shaped backside. Other shapes are feasible including contoured shapes which generally follow the body curve of the user's torso. The pouch is preferably made of a flexible, light weight and durable material such as a woven natural fabric or a woven synthetic polyester, nylon or blended fabric. Other flexible materials can be used including fabric backed vinyls and non-woven synthetic composites. Most preferably, the material is waterproof for use in outdoor inclement weather. The pouch can as well be made of a more rigid material such as leather, though preferably is made of the flexible fabric because of cost and user comfort reasons. As evident, the pouch is capable of holding a limited measure of articles such as a water bottle, sack lunch, light weight foldable jacket, keys, wallets, etc.

The pouch 11 has a cover 15 sewn along the top of a main portion of the pouch for gaining access to its interior. The cover 15 is capable of repeated openings and closings. A zipper 16 is used for securing the cover to the balance of the pouch. Other closure means such as buttons, snaps and self-sticking adhesives are usable.

A belt attaching means is positioned on the backside of the pouch. As best seen in FIGS. 1, 2, 4 and 5, a strap 17 with a terminal male buckle half 18 is a free first attaching means. The strap 17 is permanently attached to the pouch near an upper corner thereof. As discussed below, the belt 14 is permanently attached to the pouch at an opposite upper corner and further is provided with a female buckle half at one end.

Figure 3:
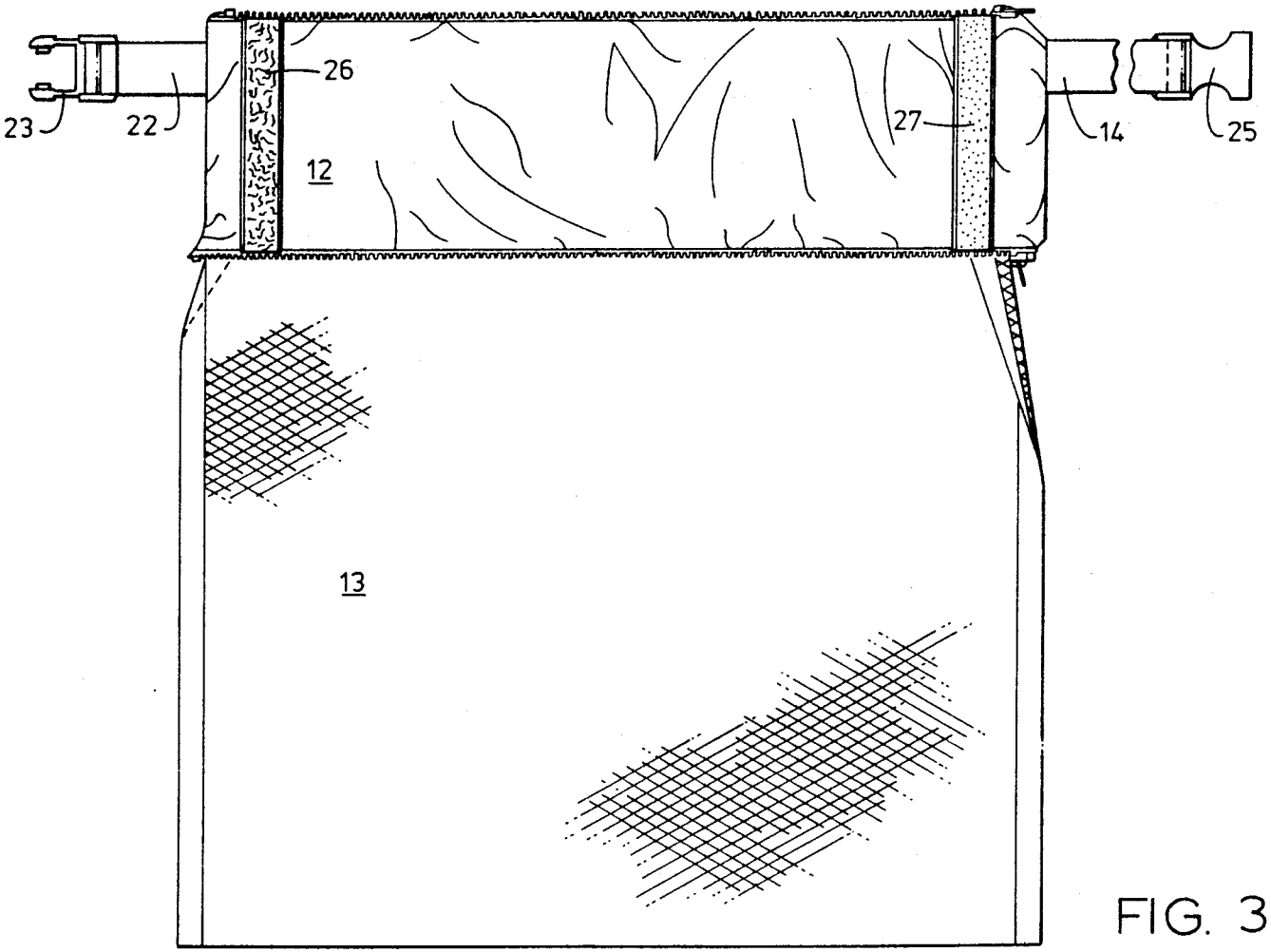
FIG. 3 is a back elevational view of the unitized pack of FIG. 2.
Figure 4:
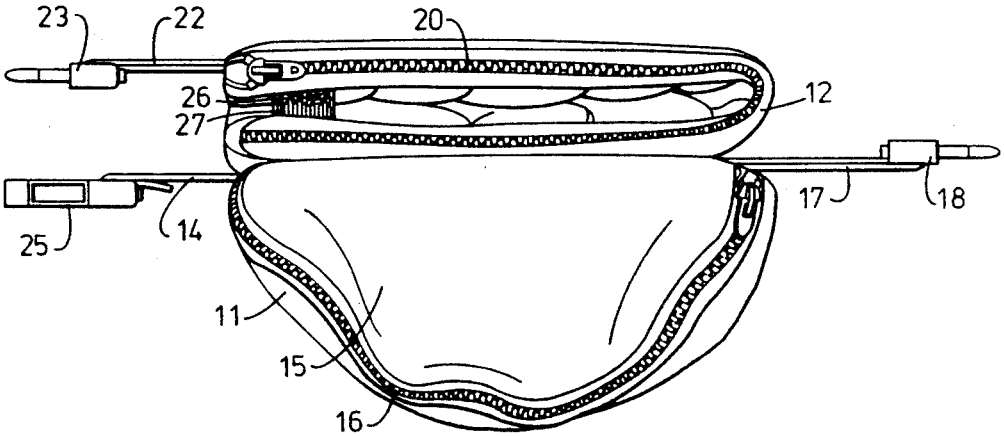
FIG. 4 is a top view of the unitized pack of FIG. 1.
Figure 5:
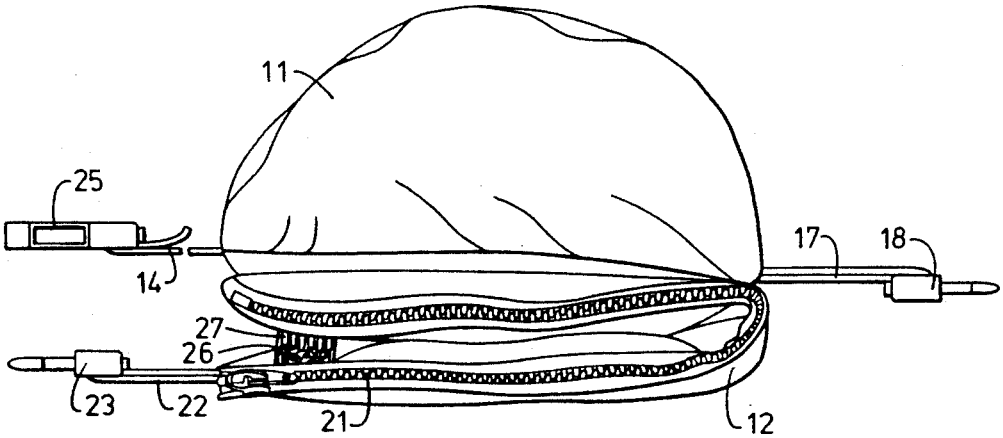
FIG. 5 is a bottom view of the unitized pack of FIG. 1.

The foldable enclosure member 12 is generally rectangular-shaped and substantially flat in both its unfolded and folded states. Its length is approximately equal to the length of the pouch while its width is approximately double the width of the pouch. The enclosure member is made of a flexible material such as those described above in connection with the pouch. Preferably, the enclosure member is made of the same flexible material as the pouch for appearance and manufacturing cost savings reasons. A portion of the enclosure member is contiguous with the pouch and is permanently attached thereto by stitches or other conventional attaching means. The balance of the enclosure member is a free portion and is folded back onto the contiguous portion as shown in FIGS. 1, 4 and 5. The free portion of the enclosure member when in-use is fully extended as shown in FIGS. 2 and 3.

The enclosure member 12 has a first closure means 20 and a second closure means 21, positioned along an upper edge and a lower edge, respectively of the member. Preferably, each of the closure means extends substantially across the width of the enclosure member. Each of the closure means best seen in FIGS. 4 and 5 is a zipper, though other closure means such as discussed above with respect to the pouch cover closure means is usable. A strap 22 with a terminal male buckle half 23 representing a free second attaching means is attached to the backside of the free portion of the enclosure member, preferably near its free vertical edge for reasons discussed below.

Positioned at least partially within the enclosure member 12 is a collapsible sack 13. The sack 13 is open topped and is permanently attached to an inside surface of the enclosure member. It is collapsible to a compact state. The sack is folded together and stored within the enclosure member during non-use, yet a main portion of the sack is capable of being dropped out of the enclosure member 12 through the lower opening during use. A gusset 24 is formed in the sack in a known manner along each vertical edge to enlarge the capacity of the sack. The sack is attached preferably by sewing an upper edge to the inside of the member 12. Preferably, the collapsible sack is made of a strong and durable open mesh material for weight reduction purposes.

Another essential component of the dual purpose unitized pack is the belt 14. As best seen in FIGS. 4 and 5, the belt 14 is permanently attached at one end to the pouch 11. The belt 14 has a mating female buckle half 25 to attach to the male buckle half 18 on the pouch or the male buckle half 23 on the enclosure member 12. The belt 14 has means on its female buckle half 25 to adjust its length depending on the particular user of the pack and depending on the mode of use, i.e. around the waist or over the shoulder.

It should be apparent that attaching means other than the buckle halves illustrated can be used. For example, a conventional buckle having an open rectangle frame and a catch can be attached to one end of the belt and the strap provided with spaced holes to receive the catch. Velcro attaching strips can also be used on the belt and strap terminuses to releasably hold together. Other known releasable attaching means are used for the purpose above described.

An optional feature, though highly preferred, is a semi-permanent attaching means to hold the enclosure member to the pouch during non-use in the folded state. Thus, a first strip of material 26 having a multitude of hook members, commercially known as Velcro is attached near one vertical edge on the backside of the enclosure member and a second strip of material 27 having a multitude of burrs, i.e. a mating Velcro material is attached near an opposite vertical edge on the backside of the enclosure member. The Velcro strips are such that they hold the enclosure member flat against the pouch, yet allows it to be readily freed and folded out.

Other optional features are added to the unitized pack dependent primarily on the perceived needs of the consumer. For example, one or more pockets can be sewn to the outside or inside of the pouch to hold change or other small objects. Loops can be added to hold various objects. Decorative designs and personalized indicia are also readily added as desired.

In operation, the dual purpose unitized pack is usually placed by the user around the waist with the belt adjusted accordingly. The flexible sack is forced into the enclosure member and each of the closure means on the enclosure member closed. Additionally, the enclosure member is folded approximately in half to lie substantially flat against the backside of the pouch. As such, the unitized pack resembles a conventional fanny pack in appearance. A limited measure of articles is placed in the pack and its cover secured close. If subsequently the user desires to collect objects or purchase items which will not fit into the pouch, he merely unfolds the free portion of the enclosure member away from the pouch, opens both enclosure member closure means and pulls or pushes down the flexible sack. If desired, the belt is adjusted for shoulder use. As such the unitized pack is now ready for use to hold a substantially larger measure of articles in the sack.

While the dual purpose unitized pack of the invention has been described in particularity with reference to the drawings, it should be understood various changes are possible. All modifications of an obvious nature are considered within the scope of the appended claims.

We claim:

1. A dual purpose unitized pack capable of use as a container for conveniently holding a limited measure of articles and as a container for holding a relatively substantial measure of articles, said dual purpose unitized pack comprising:

(a) a pouch for holding the limited measure of articles, said pouch having a free first attaching means capable of fastening to a belt;

(b) a substantially flat foldable enclosure member having a contiguous portion permanently attached to the pouch and further having a free portion folded to lie adjacent the contiguous portion in a non-use state and extending from the contiguous portion in an in-use state, said enclosure member having a first closure means along an upper edge and a second closure means along a lower edge and a free second attaching means capable of fastening to a belt;

(c) an open top collapsible sack dimensioned to fit within the enclosure member, said sack attached along one upper edge thereof to an inside wall of the enclosure member and positioned so that a main portion thereof is able to drop out the enclosure member when the second closure means is opened and to serve as a container for holding the substantial measure of articles; and (d) an adjustable belt attached on one end to the pouch and having mating attaching means at the other end capable of releasably attaching to either of the free first or free second attaching means and capable of being worn around the waist of the user or capable of being worn over the shoulder of the user as desired.

2. The unitized pack of claim 1 wherein the first and second closure means of the enclosure member are each zippers.

3. The unitized pack of claim 2 wherein the collapsible sack is made of an open mesh material.

4. The unitized pack of claim 3 including cooperating strips of hook fasteners and burr fasteners wherein one of said strips is attached to the enclosure member and another of said strips is attached to the backside of the enclosure member such that the strips fasten to one another when the enclosure member is folded behind the pouch during non-use.

5. The unitized pack of claim 1 wherein the pouch is a box-like structure with a substantially rectangular-shaped backside and the enclosure member is substantially rectangular-shaped.

6. The unitized pack of claim 5 wherein the length of the enclosure member is approximately equal to the length of the pouch and the width of the enclosure member is approximately double the width of the pouch so that said enclosure member is unnoticed when folded behind the pouch as in a non-use state.

7. The unitized pack of claim 1 wherein the pouch has a strap permanently attached thereto with the free first attaching means at a terminus thereof.

8. The unitized pack of claim 1 wherein the pouch is made of a flexible, light weight and durable material.

9. The unitized pack of claim 8 wherein the pouch is made of a synthetic woven fabric.

10. The unitized pack of claim 9 wherein the enclosure member is made of a synthetic woven fabric.

11. The unitized pack of claim 10 wherein the pouch and enclosure member are made of a waterproof nylon.

12. A dual purpose unitized pack capable of use as a container for conveniently holding a limited measure of articles and as a container for holding a relatively substantial measure of articles, said dual purpose unitized pack comprising:

(a) a pouch for holding the limited measure of articles, said pouch being a box-like structure with a substantially rectangular-shaped backside and having a free first attaching means capable of fastening to a belt;

(b) a substantially flat foldable enclosure member permanently attached to the pouch, said enclosure member being substantially rectangular-shaped wherein the length of the enclosure member is approximately equal to the length of the pouch and the width of the enclosure member is approximately double the width of the pouch so that said enclosure member is unnoticed when folded behind the pouch as in a non-use state and further said enclosure member having a first closure means along an upper edge and a second closure means along a lower edge and a free second attaching means capable of fastening to a belt;

(c) an open top collapsible sack dimensioned to fit within the enclosure member, said sack attached along one upper edge thereof to an inside wall of the enclosure member and positioned so that a main portion thereof is able to drop out the enclosure member when the second closure means is opened and to serve as a container for holding the substantial measure of articles; and (d) an adjustable belt attached on one end to the pouch and having mating attaching means at the other end capable of releasably attaching to either of the free first or free second attaching means and capable of being worn around the waist of the user or capable of being worn over the shoulder of the user as desired.

13. The unitized pack of claim 12 wherein the collapsible sack is made of an open mesh material.

14. The unitized pack of claim 13 including cooperating strips of hook fasteners and burr fasteners wherein one of said strips is attached to a backside of the enclosure member near one vertical edge thereof and another of said strips is attached to the backside of the enclosure member near an opposite vertical edge thereof such that the strips fasten to one another when the enclosure member is folded behind the pouch during non-use.

15. The unitized pack of claim 14 wherein the pouch has a strap permanently attached thereto with the free first attaching means at a terminus thereof.

16. The unitized pack of claim 12 wherein the pouch is made of a flexible, light weight and durable material.

17. The unitized pack of claim 16 wherein the pouch is made of a synthetic woven fabric.

18. The unitized pack of claim 17 wherein the enclosure member is made of a synthetic woven fabric.

19. The unitized pack of claim 18 wherein the pouch and enclosure member are made of a waterproof nylon.

* * * * *